United States Patent [19]

Nicolas et al.

[11] Patent Number: 4,510,869

[45] Date of Patent: Apr. 16, 1985

[54] ROTATING CAGE SECURITY DEVICE FOR A GYRATORY PROJECTILE

[75] Inventors: Jacques Nicolas, Riom; Roland Raso, Vichy, both of France

[73] Assignee: Manufacture de Machines du Haut-Rhin, "Manurhin", Mulhouse, France

[21] Appl. No.: 534,554

[22] Filed: Sep. 22, 1983

[30] Foreign Application Priority Data

Sep. 24, 1982 [FR] France ..... 82 16097

[51] Int. Cl.[3] ..... F42C 15/04; F42C 15/22; F42C 15/34

[52] U.S. Cl. ..... 102/240; 102/237; 102/245; 102/246

[58] Field of Search ..... 102/240, 237, 246, 244, 102/245, 254

[56] References Cited

U.S. PATENT DOCUMENTS

| | | | |
|---|---|---|---|
| 3,585,935 | 6/1971 | Birkist | 102/240 |
| 3,994,230 | 11/1976 | Kalin | 102/240 X |
| 3,995,557 | 12/1976 | Engle et al. | 102/240 X |
| 4,242,963 | 1/1981 | Ziemba | 102/240 X |

FOREIGN PATENT DOCUMENTS

| | | | |
|---|---|---|---|
| 2330013 | 1/1975 | Fed. Rep. of Germany | 102/240 |
| 2539750 | 3/1977 | Fed. Rep. of Germany | 102/245 |

*Primary Examiner*—David H. Brown

[57] ABSTRACT

The security device of the invention comprises a movable organ in the interior of a cage mounted for rotation with respect to the body of a projectile, the movable organ being temporarily blocked from such rotation around the axis of gyration by at least one pin ejectable under the action of centrifugal force. Said pin is itself retained by an elastic spiral band enrolled upon the cage and which, as a result of a difference introduced into the speeds of respective rotation of the cage and of the body around the axis of gyration upon the exit of the projectile from the muzzle of the weapon, unwinds to liberate the pin. As a result, the movable organ after a trajectory of many tens of meters after the projectile has left the muzzle of the barrel of the weapon completes the pyrotechnic train which fires the projectile.

6 Claims, 5 Drawing Figures

ROTATING CAGE SECURITY DEVICE FOR A GYRATORY PROJECTILE

The present invention relates to a rotating cage security device for a gyratory projectile.

Such projectiles, which carry an explosive, are equipped with a firing means for the charge and, to prevent the accidental firing of the charge during storage of the projectile, the loading of the projectile into the weapon, or the passage of the weapon through the barrel of the weapon after the weapon has been fired, and during the first meters the travel of the projectile after its exit from the barrel of the weapon, are always equipped with security devices which prevent their functioning until they have been fired so that the projectile cannot explode until it has left the barrel of the weapon.

For this purpose there has been used, for example, a gyroscopic rotor tending to tilt, during the gyration of the projectile, from one position in which its axis of inertia makes a certain angle with the axis of gyration of the projectile and in which it interrupts a pyrotechnic chain of the projectile, to a position in which the two axes are aligned and in which the continuity of the pyrotechnic chain is completed.

The alignment of the inertia axis of the gyroscopic rotor with the axis of gyration of the projectile results only when the projectile is submitted to a gyration, that is to say only after its firing; it is desired to prolong the security during a certain period of time after firing, so that the projectile will have traveled a distance of some meters away from the muzzle of the weapon. For this purpose, there has been provided a securing or latching means by tapered pin, cotter pin, or other analogous means in order to maintain for a desired time, or during the travel of the projectile over a desired distance, the gyroscopic rotor in an immovable state with respect to the body of the projectile, so as to maintain the security on the one hand and on the other hand to assure the driving of the rotor in rotation around the axis of gyration of the projectile, a condition necessary to obtaining the ultimate gyroscopic effect provoking, after releasing the holding of the gyroscopic rotor, the passage of the rotor into the position in which its inertia axis is aligned with the axis of gyration of the projectile. Such releasing of the gyroscopic rotor is controlled by a clock or mechanical means, released by an accessory means, for example by inertia at the instant of firing of the projectile.

Such known mechanisms are complex when it is desired to maintain the security over a distance of many tens of meters of the path of the projectile from the muzzle of the weapon, and presents a large encumbrance, thus reducing their scope of application to those of large caliber projectiles; for projectiles of smaller caliber, in which the volume available for the security device is reduced, it is necessary to limit the use of the security device, if such devices prevent the firing of the projectile over distances on the order of 25 to 30 meters. That is to say such security devices provide security only in the case of mechanical shock to which the projectile is submitted during its storage, its manipulation, and at the beginning of its trajectory, even though such security means operates by the interruption of a pyrotechnic chain and offers as a consequence a security during its storage and manipulation, such means do not insure that the projectile will not be fired until it has traveled some distance in its trajector after its issuance from the muzzle of the barrel of the weapon.

The above-discussed prior security mechanisms are disclosed for example in French Pat. Nos. 74 19.921 and 75 36.126, as well as U.S. Pat. No. 3,076,410.

The present invention has among its objects the provision of a security mechanism for a gyratory projectile adapted to function by the interruption of a pyrotechnic chain, or by the interruption of an electric or fluid circuit of a firing means, or, to the contrary, by the closing of an electric circuit which powers the security functions, in a particularly efficient manner, and which assures in a device of reduced weight by means of simple mechanisms which are economical and assure in their operation a security over a distance of a plurality of tens of meters after the exit of the projectile from the muzzle of the weapon.

The security mechanism according to the invention is disposed in the interior of the body of the projectile, such projectile having a definite axis of gyration, parallel to a predetermined direction of translation of the projectile, a movable means such for example as a gyroscopic rotor and at least one locking means movable under the action of centrifugal force produced by the gyration of the projectile, the movable locking means being movable from a position in which it occupies a predetermined position to immobilize the security means to a position of freedom of the movable member in which such cooperation ceases. The said movable means is disposed in the interior of a cage mounted for free rotation around the axis of gyration of the projectile with respect to the body of the projectile, at the interior of the body by the intermediary of mounting means permitting the translatory motion of the cage with respect to the body of the projectile parallel to the axis of its gyration, between two abutment faces respectively forwardly and rearwardly of the body of the projectile, referring to the direction of translation or travel of the projectile.

The security mechanism is so constructed and arranged that the acceleration and deceleration which the projectile undergoes successively during its travel in the barrel of the weapon and after its leaving the muzzle of the barrel moves the cage and the body respectively in driving relationship from a first to a second position of conjoint gyration by friction of the cage against the rear face and by friction of the first by the second by reason of gyration of the cage upon the forward face, with a transitional period, corresponding to the travel through the play, during which the cage is free to gyrate with respect to the body and to turn around the axis of gyration with a speed of gryation greater than that of the body, in which the pin is mounted to slide radially in the cage, in reference to the axis of gyration, between the said position of locking in which such zone closely approaches the axis of gyration cooperates with the movable organ, in the interior of the cage, in order to immobilize such organ in said predetermined position with respect to the cage and in which the zone which is closest to the axis of gyration becomes even with a peripheral external face of the cage, which is a body of revolution around the axis of gyration, and said position of freedom closer to the axis of gryation and in which the zone closely approaches that of the liberated organ.

The mechanism is provided at least with one spiral elastic band interposed between the exterior peripheral face of the cage and an interior peripheral face of the body in which the mass, the form, the rigidity, and the prestress are such that they are rolled around the exterior peripheral face of the cage and grip it in a solid manner by friction in the position of repose of the projectile and during which it is submitted, in engaging against the rear abutment face of the body during acceleration of the projectile in the barrel of the weapon, a conjoint gyration with the body at a speed ranging from the value of zero to a maximum value and such that the external layer of the band tends to disengage itself from the next inner layer thereof under the action of centrifugal force for a value slightly less than or equal to the maximum value, in order to engage the interior peripheral face of the body and to become solid therewith by friction, in such manner that, during the said transitional period and after the cage engages against the forward abutment face of the body during the deceleration of the projectile after it has left the muzzle of the weapon, the difference between the respective speeds of gyration of the cage and of the body introduced during said transitional period causes a centrifugal unwinding of the elastic spiral band, with the liberation of the pin or pins in the direction from the position in which it locks the mobile organ to the position in which the mobile organ is freed.

Thus, in introducing, by reason of an axial play between the cage and the body, a difference between their respective speeds of gyration during a transitory period corresponding to that of the leaving of the body of the projectile from the muzzle of the weapon, the projectile undergoes a very pronounced deceleration immediately following an acceleration, during which the cage, momentarily free from the body, is subjected to a less energetic deceleration, and in using this difference of speed in order to arm or cause the unwinding of the spiral band, which then causes the braking of the gyration of the cage by the body by reason of their mutual contact with the forward abutment face does not cause an immediate equalization of their speed, the liberation of the locking pin is retarded, that is to say the locking of the movable organ such as a gyroscopic rotor, for a time corresponding to travel of the projectile from the muzzle of the weapon for a plurality of tens of meters.

It is to be noted that it has already been proposed to utilize spiral springs which unwind under the centrifugal force in order to immobilize a firing pin; however, such spiral springs unwind in a few meters of the trajectory of the projectile, after which the security disappears; it can be easily seen that the unwinding of a sprial spring between a turning cage in the body of the projectile, as set forth in accordance with the present invention, permits considerable slowing down of the unwinding of the elastic spiral band, and as a consequence considerably augments the distance of travel of the projectile in which it is prevented from firing.

Other characteristics and advantages of the invention will appear in the following description, relative to a non-limiting preferred example thereof, as well as the annexed drawings which form an integral part of such description.

Such example corresponds to the case in which one utilizes a security device according to the invention to immobilize a gyroscopic rotor in an out-of-axial position with respect to the axis of gyration of the projectile, the rotor placing itself after it is freed into a position in which it assures the continuity of the pyrotechnic chain of the projectile; furthermore, as has been said above, the field of application of the invention is not limited to the momentary locking of such gyroscopic rotors, and it can notably be applied in the closing or opening of electric or fluid circuits in which a gyroscopic rotor or any other movable organ performs the function of an interrupter of the pyrotechnic chain.

Figure 1:
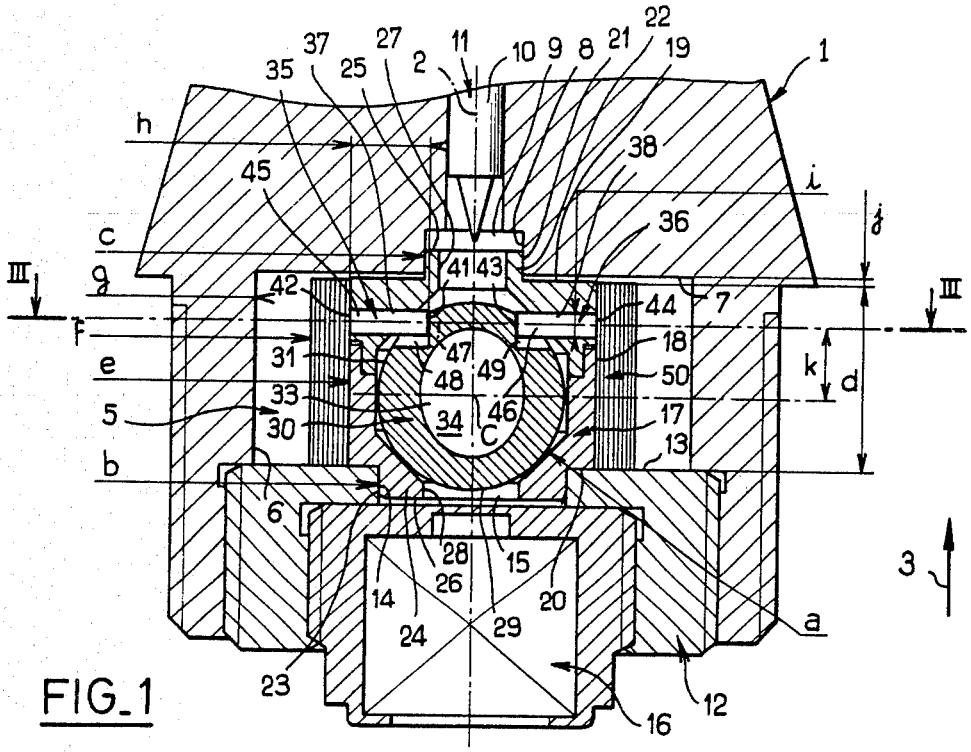
FIG. 1 is a view partially in side elevation and partially in axial section, of a preferred embodiment of the security device of the invention when such device is in repose or during the acceleration phase of the projectile before it has left the muzzle of the barrel of the weapon.
Figure 3:
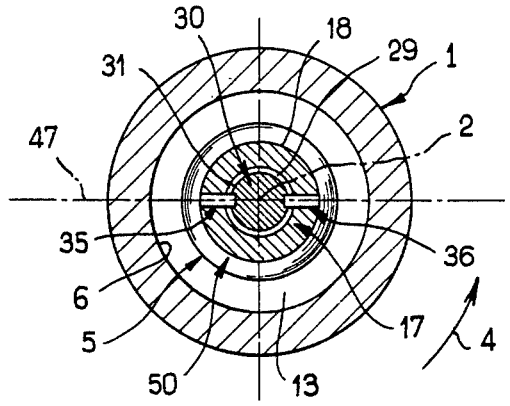
FIG. 3 is a view in section through the device of the invention, the section being taken along the plane III—III in FIG. 1.
Figure 4:
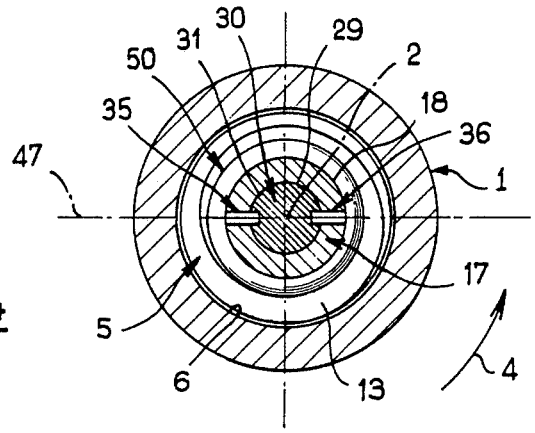
FIG. 4 is a view similar to FIG. 3 but showing the parts in the positions they assume during the period of unwinding of the spring in the device.
Figure 5:
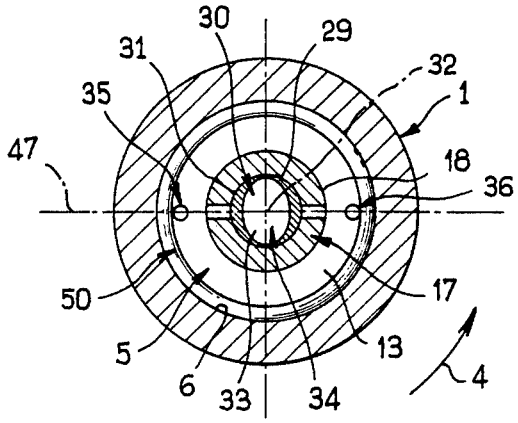
FIG. 5 is a view in cross-section of the device of the invention, the section being taken along the plane V—V in FIG. 2.

Turning first to FIG. 1, character 1 designates the body of the fuse there shown, such body being a body of revolution about a central axis 2 which constitutes the axis of turning of the body 1 when, traveling in a direction 3 parallel to axis 2, the fuse body 1 turns about its axis in the direction 4 shown in each of FIGS. 3, 4 and 5. Direction 4 is determined by the hand of the rifling in the barrel of the weapon from which the projectile is fired; the direction of turning 4 indicated in FIGS. 3, 4 and 5 corresponds to the firing of a projectile of which the barrel is rifled in the direction to the right, by way of a non-limiting example.

By convention, the directions 3 and 4 will serve as reference directions in the following description, and, notably, the terms "forward" and "rear" employed in the following are to be given the meaning they have with reference to direction 3.

At its rear end, the body 1 has a tubular form and has in its interior a cavity 5 which opens toward the rear and is limited within the body 1 by a peripheral interior face 6 in the form of a cylinder of revolution about the axis 2 and by a forward annular face 7 lying in a plane disposed transversely with respect to the axis 2 and joined by its external periphery of the face 6 and by the interior periphery of an interior peripheral face 8 which forms a cylinder of revolution about axis 2 with a diameter less than that of face 6. An orifice 9 opens centrally into the cavity 5 and communicates in a forward direction with a bore 10 formed in the body 1 for the guiding of a firing pin 11 disposed along the axis 2. The firing pin 11 is shown in FIG. 1 in its rear, percussion position, wherein it has moved into the interior of the cavity 5; it is to be understood that the firing pin 11 could not have reached the position thereof shown in FIG. 1 unless the safety device according to the invention had been operated.

At the interior of the cavity 5, the body 1 carries a collar 12 screwed into the rear of the body 1, collar 12 having a transverse annular plane foward face 13 disposed transversely of the axis 2. Collar 12 is joined at its external periphery to the face 6 of the cavity 5 and by its internal periphery to an internal peripheral face 14, forming a cylinder of revolution around the axis 2, of an orifice 15 of the collar 12. The orifice 15 opens in a foward direction in such face 13 and toward the rear with respect to a pyrotechnic relay 16 fixedly carried by the collar 12 at the rear of the face 13. The face 13 thus defines the rear face of the cavity 5.

At the interior of the cavity 5 thus defined by the faces 6, 7, 13 in accordance with the invention there is mounted a cage 17 which is defined, if one refers to the mounted state of such means, by an external peripheral face 18 which forms a cylinder of revolution about the axis 2, and by two plane annular faces, disposed transversely with respect to the axis 2 and joined to the face 18 by their respective external peripheries, that is, by a forward face 19, turned in a forward direction and by the consequent placing with respect to the forward face 7 of the cavity 5, and by a rear face 20 turned toward the rear and as a consequence disposed with respect to the rear face 13 of the cavity 5. The diameter of the face 18, which defines the external diameter of faces 19 and 20, is intermediate between the diameter of the face 6, on the one hand, and the respective diameters of the faces 8 and 14, on the other hand.

It should be noted that, in accordance with the invention, the distance d in a direction parallel to the axis 2 between the faces 19 and 20 is less than a value j which is the distance between the faces 7 and 13, measured in the same fashion as distance d.

At its interior periphery, the face 19 of the cage 17 is adjacent to an exterior peripheral face 21, which is in the form of a cylinder of revolution about the axis 2 having a diameter closely near that of the interior peripheral face 8 of the orifice 9. A member 22 in the form of a bearing is integral with the cage 17 and extends through the front with respect to its face 19, and is disposed in the orifice 9 in order to assure, by a gliding contact between the faces 8 and 9, a guiding of the cage 17 in its rotation about the axis 2 with respect to the body 1. The face 20 of the cage 17 is adjacent, at its interior periphery, to an exterior peripheral face 23, face 23 being in the form of a cylinder of revolution about the axis 2 having a diameter also near as possible to that of face 14. A bearing 24 receives the rear part of the cage 17 and guides it by its face 20, bearing 24 being received in the orifice 15 in such manner as simultaneously to ensure a guiding of cage 17 in relative rotation, by sliding mutual contact between the faces 23 and 14.

Toward the front, the exterior peripheral face 21 of the bearing 15 is adjacent to the external periphery of an annular face 25, disposed transversely with respect to the axis 2, face 25 delimiting the bearing 22 in a forward direction, while to the rear, the external peripheral face 23 of the bearing 24 is adjacent to the external periphery of an annular face 26, disposed transversely with respect to the axis 2, which limits the movement of the bearing 24 toward the rear. The distance separating respectively the face 25 from the face 19 and the face 26 from the face 20 parallel to the axis 2 is greater than the play j and less respectively than the length of the face 8 or that of the face 14 measured parallel to the axis 2. Because of this, the cage 17 and the body 1 are able to undergo a relative translation following such axis, in one direction or another, limited by the distance j, without escape and while conserving a coaxiality as good as possible, by the relative gliding of the faces 21 and 8 and the faces 23 and 14 parallel to the axis 2.

The bearings 22 and 24 are hollow and, by their respective interior peripheries, the faces 25 and 26 abut an interior peripheral face, respectively 27 or 28, which is in the shape of a circular cylinder coaxial with the axis 2, opening to the interior of the cage 17 in a seat 29 constituting a vertical bearing assuring the guidance, in rotation in every direction around a center C disposed on the axis 2 and in every way possible fixed with respect to the turning cage 17, for a gyroscopic rotor 30.

For this purpose, the seat 29 presents a peripheral interior face presenting a spherical interior envelope coaxial of the center C, and the gyroscopic rotor 30 presents an external peripheral face 31 also spherical, with a diameter as close as possible to the diameter of such envelope of which the center of such face 31 coincides with as precise a manner as possible with the center C, and which is disposed as accurately as possible upon the axis 2.

The gyroscopic rotor 30 presents an inertia axis proper 32 and has an opening therethrough following such axis, presenting an opening 33 in the interior of which there is mounted a detonator 34, the form and dimensions of opening 33 in a transverse section with respect to the axis 32 and the diameter of the interior peripheral face 27 of the bearing being such as to permit the passage of the firing pin 11 towards its percussion position when the axis 32 coincides with the axis 2 in a predetermined position of the gyroscopic rotor 30 in the interior or the cage 17. Such position of the axis 32 is attained by reason of the driving rotation about the axis 2. In such position, the rotor establishes the continuity of a pyrotechnic chain which includes a firing pin 11, the bearing 22, the opening 33 with the detonator 34, the bearing 24 and the firing ignitor or relay 16.

In order to establish a security of interruption of such pyrotechnic chain during the storing of the projectile, the loading of the projectile into the weapon, the travel of the projectile through the barrel of the weapon, and during the first meters of the trajectory of the projectile, the rotor 30 is retained in such a position that its inertia axis proper 32 is tipped angularly with respect to the axis 2, in reference to the center C, that is to say, in a position in which its opening 33 is not placed with regard to the piercing pin 11, by the blocking means which will presently be described.

Such blocking means comprises notably at least one pin disposed radially with respect to the axis 2, and by preference a plurality of such pins oriented radially with respect to the axis 2 and uniformly spaced angularly with respect to axis 2, in order temporarily to immobilize the gyroscopic rotor in the interior of the cage 17 in a position which is out of alignment with the axis 2.

In the illustrative example, there are thus provided two aligned pins 35 and 36 each one of which presents an external peripheral face, 37 and 38, respectively, in the form of a cylinder of revolution around an axis, respectively 39 and 40, and two outer faces respectively, 41 and 42 and 43 and 44 disposed transversely with respect to such proper axis.

To insure the immobilization of the rotor 30 with respect to the cage 17 in a misaligned position, the pins 35 and 36 are retained in respective holes or seats 45 and 46, which are in the form of cylinders of revolution about the same axis 47 perpendicular to the axis 2. The cage 17 presents an interior seat 29 between its faces 19 and 20, which join the external peripheral face 18 of the cage 17. The seats 45 and 46 present an interior diameter complementary to the respective diameters of the faces 37 and 38 of the pins 35 and 36 in order to receive them in a gliding manner around the axis 47, in a position in which the respective axes 39 and 40 of the pins are coaxial of the axis 47.

The axial length of the pins 35 and 36, measured between the faces 41 and 42 and between the faces 43 and 44 parallel to their respective axes, is such that, when they are engaged in a respective hole 45 or 46 of the cage 17 in a position in which one of their extremities, respectively, 42 or 44, extends beyond the peripheral external face 18 of the cage 17, their other extremity, respectively 41 or 43 being disposed near the axis 2, penetrating the interior of the interior spherical seat 29 and engaging in a notch respectively, 48 or 49, which presents respectively in regard to the hole 45 or with respect to the hole 46 following the axis 47, the peripheral external face 31 of the gyroscopic rotor 30 when such rotor occupies the out of axial position of its inertia axis proper 32 with respect to the axis of gyration 2 of the body 1 chosen as the position of security.

The pins 35 and 36 thus seated in the holes 45 and 46 of the cage 17 are ejectable under the action of centrifugal force when such cage 17 turns about the axis 2, but a restraining element opposes such ejection during the first meters of travel of the projectile in its trajectory.

Such restraining element is formed, in accordance with the invention, as a spiral elastic band or spiral spring 50 disposed coaxially of the axis 2, interposed between the peripheral face 18 of the cage 17 and the peripheral interior face 6 of the cavity 5 of the body 1. The member 50 presents a mass, a form, a rigidity, and an initial winding such that, at rest, that is to say when the cage 17 is motionless, the spiral elastic band 50 is rolled around the peripheral external face 18 of the cage 17 and enclosing it in such manner as to be held rigidly with respect thereto by friction, and such that later the band is unwound by a function which is easily determined by one skilled in the art given the values of the mass (notably in terms of linear mass), its form (notably in terms of the length of the band), its rigidity and its pretensioning when it is wound up, in use, about the face 18 of the cage 17.

In repose, that is to say before the storage and the loading the projectile into a weapon, the elastic spiral band 50 is wound around the peripheral exterior 18 of the cage 17, and retains the pins 35 and 36 in the position thereof (FIG. 1) such that their inner ends 41 and 43 are engaged in the notches 48 and 49 in the gyroscopic rotor 30 as it occupies a position out of alignment with axis 2, to assure security. The turning cage 17, as well as the elastic spiral band 50 which is then solidly attached thereto, are then free to rotate around the axis 2 with respect to the body 1 by reason of the journal bearings 22 and 24 and the play j in the direction parallel to the axis 2, between the respective transfer spaces with respect to such axis of the body 1 and the cage 17. It is to be noted that, advantageously, the elastic band 50 presents in a direction parallel to the axis 2 a dimension at least equal to the dimension d which separates the faces 19 and 20, the band 50 being wound up around the face 18 in a position such that it does not extend past the faces 19 and 20.

At the moment of firing of the projectile, and after its travel in the barrel in the weapon, assumed to be the direction to the right in the illustrative example, the projectile, and, with it the body of the fuse 1 is displaced in the direction 3 while being subjected to a powerful acceleration, the value of which is, for example, on the order of 60,000 to 120,000 times the value G (force of gravity), and all the elements capable of being displaced in the interior of the body 1 position themselves to the rear as far as possible in the cavity in the body. Notably, the cage 17 by its face 20 and the elastic band 50 are displaced toward the rear against the face 20 of the cavity 5, which furnishes a stop to the rear and assures by friction their becoming in effect a solid in rotation around the axis 2 with the body 1. As a consequence, the spiral elastic band 50, the cage 17, and the elements which are entrained in the rotation about the axis 2 at the same speed as the body 1, in the same sense for, attain at the muzzle of the barrel of the weapon a maximum speed of rotation which is, for example, on the order of 40,000 to 60,000 rpm, which rose from an initial value of zero.

Such state of total solidarity of the different elements in the device with the body 1 is illustrated in FIGS. 1 and 3.

After the projectile issues from the muzzle of the barrel, the acceleration in the direction 3 ceases, to be replaced by a deceleration the value of which is, for example, on the order 40 times the value G. All the movable elements of the device in the interior of the body 1 now tend to move forwardly within the body to the full extent possible and, notably, the cage 17 moves forwardly through the distance j of the play, being stopped by engagement of its face 18 against the face 7 of the cavity 5 which furnishes a stop, and tends by friction to make all of the elements within the body 1 move as a unit in rotation about the axis 2.

During the taking up of the distance j with respect to the body 1, by displacement with respect about the axis 2, the cage 17 is independent of the body 1 vis-a-vis such a rotation; since the body 1 dips immediately after issuance of the projectile from the muzzle of the weapon, and the speed of translation as well as the speed of rotation immediately decelerates, the cage 17 which at first moved only to take up the play space j continues to turn at a speed which is substantially constant, at which the speed of rotation of the body 1 around the axis 2 tends to decrease more and more, until contact is established between the faces 19 and 7 and, by friction, provokes an progressive equalization of the two speeds while conserving at all times, until such equalization, a speed of rotation which is greater than that of the cage 17.

During the transitional period of independence of the cage 17 to the rotation around the axis 2 with respect to the rotation of body 1, and until a new equalization is achieved as to such speeds of rotation, the spiral elastic band 50 is progressively unwound in an appropriate manner depending upon the parameters, above discussed, of such band.

These parameters are such that, for a conjoint value of speed of rotation of the spiral band 50 and the cage 17 with which it is initially solid as a result of friction, slightly inferior to, or equal to the maximum value of the conjoint speed of rotation of the body 1, of the cage 17, and of the band 50 as the projectile leaves the muzzle of the weapon, the external turn of the spiral band 50 tends to fly outwardly toward the exterior under the action of centrifugal force and to come forcibly into contact with the interior peripheral face 6 of the cavity 5. Thus, when the spiral band 50 with the cage 17, escapes, at the beginning of the above-described transitional phase, from the solidarization by friction against the face 13 with the body 1, the conjoint rotation of such spiral band 50 and the cage 17 at a speed equal to the maximal speed of rotation of the projectile as it issues from the muzzle of the weapon or even near such value immediately provokes engagement of the outer turn of the band 50 against the face 6 of the cavity 5 with which it become solid by friction. But, the angular speed of the face 6, forming a part integral with the body 1, is then less than that of the external peripheral face 18 of the turning cage 17; this accordingly introduces the difference in the respective angular speeds of the outer turn of the spiral band 50, turning at the angular speed of the body 1, and the innermost turn of the spiral band 50 turning at the annular speed of the cage 17. As a consequence, the progressive centrifugal unwinding of the spiral band 50 as is illustrated in FIG. 4, in which such spring has also such effect, the rolling up of the spiral band 50 is such that its respective zones more and more approach the axis 2 in the direction 4 of gyration.

Simultaneously and proportionately as the turns of the spiral band 50 successively unwind with reference to the external face 18 of the cage 17, by reason of centrifugal force, against the preceding turns and rolled against the exterior peripheral face 6 of the cavity 5, such turns become solid with the body 1 under the action of centrifugal force, which maintains and causes the process.

Figure 2:
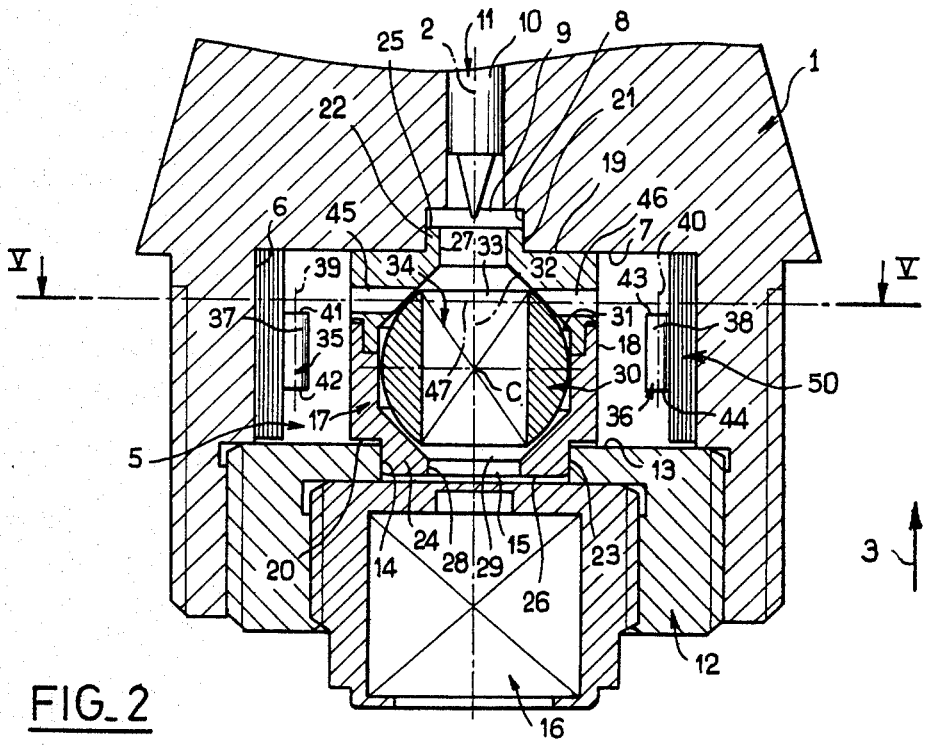
FIG. 2 is a view similar to FIG. 1 showing the deceleration phase of the projectile when it has left the muzzle of the barrel weapon.

At the end of such process, which occurs much later, by the mutual friction of the faces 19 and 7, the speed of rotation of the turning cage 17 becomes equal to that of the body 1, the spiral band 50 is integrally wound against the peripheral external face 6 of the cavity 5 and is solid with the body 1 by friction because of centrifugal force, and the external peripheral face 18 of the cage 17 is totally disengaged, notably with regard to the holes 45 and 46 of which the pins 35 and 36 can then be ejected under the action of centrifugal force, the pins then being placed against the interior turn of the band 50 rolled against the face 6, as is shown in FIGS. 2 and 5. Naturally, the dimensioning of the different elements of the apparatus is established as a function of such possibility of disengagement, of which one notes that it is useful to the attainment of the equalization of the respective speeds of rotation of the cage 17 and of the body 1 about the axis 2, that is to say the lengthening of the time which can be attained for the above-described process of unwinding of the band 50 by centrifugal action.

Since the movement of the pins 35 and 36, their respective extremities 48 and 49 initially the closest to the axis 2 accomplish a centrifugal movement and, in the course of such movement, disengage from the notches 48 and 49 of the gyroscopic rotor 30, and are then vis-a-vis a gyroscopic movement to the interior of their seats 29 in the cage 17, being led into a position of alignment of its inertial axis proper 32 with the axis of gyration 2.

Naturally, the means which is to be described may be realized over a range of dimensions which is extremely large, and one will find below, by way of a non-limiting example, an indication of the limits and the tolerances corresponding to the actual construction of the apparatus for calibers on the order of 30 to 155 mm, by way of non-limiting example.

The following values are established by reference to the diameter a of the gyroscopic rotor 30:

diameter a of the rotor 30: of 6 to 20 mm;

play of the rotor 30 in the seat 29 of the turning cage: from 0.7 to 1.5% of a:

diameter of the peripheral external face 23 of the bearing 24 and of the interior peripheral face 14 of the orifice 15: b=a;

diameter of the peripheral external face 21 of the bearing 22 and of the peripheral interior face 8 of the orifice 9: c=a/2;

diameter of the external peripheral face 18 of the turning cage 17: e=4/3 a;

external diameter of the spiral elastic band 50 when it is rolled around the external peripheral surface 18 of the turning cage 17: f=9/5 of a;

diameter of the peripheral external face 6 of the cavity 5: g=7/3 a;

distance between the faces 19 and 20 of the turning cage 17: d=a;

value of play between the turning cage 17 and the body 1 parallel to the axis 2: j=from 1.5 to 4% of a;

length of a pin 35 or 36, measured parallel to the respective axis 39 or 40: h=2/5 a;

diameter of the external peripheral face 37 or 38 of a pin 35 or 36: i=a/7;

distance separating the axis 47 of the holes 45 and 46 from the center C of the seat 29, parallel to the axis 2: k=4/10 a (the axis 47 being situated between the center C and the face 19 of the cage 17);

play of the bearings and pins in the respective orifices or holes: from 0.7 to 1.5% of a;

State of surface: Ra1.6
√ thickness of the elastic spiral band 50: 25 microns;

unrolled length of the spiral band 50: from 2 to 3 meters.

The above example corresponds to the use of a single spiral elastic band 50, as illustrated, but it is to be noted that the invention is not limited thereto since the single elastic spiral band may be replaced by a plurality of similar bands juxtaposed following the direction of the axis of gyration 2 and of the mass, the form, the rigidity, and the prestressing of the springs which are employed, in such manner as to render solid by friction the external peripheral face 18 of the cage 17 when the device is in repose, and which is such that it causes, in engaging the rear abutment face 13 of the body 1 under the condition of acceleration of the projectile in the barrel of the weapon, a conjoint gyration with the body at a speed extending from the value zero to a maximum value. Moreover, such values must be such that the exterior turn of the band 50 tends to expand under the centrifugal force for a value slightly less than or equal to the maximum value necessary to place the outer turn of the band against the interior peripheral face 6 of the body and render it solid therewith by friction, to cause the unrolling of the band 50 as described above, for a length of time during which the cage 17 turns faster than the body 1 around the axis 2 after the projectile has issued from the muzzle of the weapon.

According to another variant, around the spiral elastic band 50 there may be coiled at least a second spiral elastic band presenting a mass, a form, a rigidity, and a prestressing such that it can be coiled around the external turn of the band 50 and be made solid therewith under friction when the device of the invention is at rest and such that the cage is subjected, in causing engagement between the rear abutment face 13 of the body 1 under the acceleration of the projectile in the barrel of the weapon and conjoint gyration with the body 1 at a speed in the range from the value 0 to a maximum value. Such value must be such that the outer turn of the second spiral band tends to expand under the action of centrifugal force of a value slightly less than or equal to the maximum value which allows it to engage the inner peripheral face 6 of the body 1 and to become solid with it under the action of friction under the above-described conditions, in such manner that, successively, the second band and then the first band, liberated by a second band, undergoes the above-described process leading to the engagement against the peripheral interior face 6 of the body 1, by the intermediary of the second spiral band acted upon by the spiral band 50. There can then be employed two spiral bands made of different materials such as aluminum for the interior band and brass for the exterior band; still further, the two bands may be made of plastic materials.

Naturally, more than two spiral elastic bands may be thus employed about the axis 2, radially outwardly with respect thereto, the plurality of elastic spiral bands in this embodiment being disposed side by side.

Although the invention is described and illustrated with reference to a plurality of embodiments thereof, it is to be expressly understood that it is in no way limited to the disclosure of such preferred embodiments but is capable of numerous modifications within the scope of the appended claims.

We claim:

1. Security device for a gyratory projectile presenting a definite axis of gyration parallel to the definite direction of translation of the projectile, comprising a movable organ in the interior of the body of the projectile, at least one securing pin for such movable organ, said pin being movable, under the action of centrifugal force which accompanies the gyration of the projectile, from one position of security of the movable organ in which it cooperates with such organ to immobilize said organ in such one position of security, to a second position, of freedom of the movable organ in which such cooperation between the organ and the pin ceases, the said organ being movable in the interior of a cage which is mounted in the body of the projectile for free rotation around the axis of gyration with respect to the body, means mounting the cage so as to permit a play of the cage with respect to the body in a direction parallel to the axis of gyration of the projectile between two abutment faces respectively before and behind the body with reference to the direction of translation of the projectile, whereby the acceleration and the deceleration to which the body is successively subjected respectively during its trajectory in the barrel of the weapon and after the exit of the weapon from the barrel puts the cage and the body respectively in relationship to the driving of the cage by the body by their conjoint gyration by friction of the cage against the rear abutment and in relation by friction of the first by the second by the gyration by friction of the cage against the forward abutment face, with a transitory period corresponding to the passing through the play by the cage during which such last is free from the gyration with respect to the body and turns around the axis of gyration at a speed of gyration which decreases less rapidly than that of the body and is superior to such speed, the said pin being mounted to slide radially in the cage in reference to the axis of gyration between on the one hand a position of locking in which its radially inner end more nearly approaches the axis of gyration and cooperates with the mobile organ in the interior of the cage, to immobilize such organ in said definite position with respect to the cage and in which the radially outer end of the pin, the more distant from the axis of gyration lies substantially even with the exterior peripheral face of the cage to form a cylinder of revolution around the axis of gyration, and on the other hand a position of liberation further from the axis of gyration and in which the formerly radially inner end of the pin more closely approaches the free mobile organ, and there is provided at least a spiral elastic band interposed between the external peripheral face of the cage and an inner peripheral face of the body, the mass, the form, the rigidity, and the prestress of the spiral elastic band being such that they are rolled around the external peripheral face of the cage and grip it in such manner as to be become solid by friction with it in repose and such that it sustains, in abutting against the rear abutment of the body upon the acceleration of the projectile in the barrel of the weapon, a conjoint gyration with the body with a speed ranging from the value zero to a maximum value, the spiral elastic band expanding exteriorally to become disengaged from the cage under the action of centrifugal force having a value slightly less than or equal to such maximum value in order to engage the peripheral inner face of the body and become solid with it by friction, whereby during said transitory period and when the cage engages against the forward abutment face of the body in the deceleration of the projectile outside the muzzle of the barrel of the weapon, the difference between respective speeds of gyration of the cage and the body, introduced during said transitory period, provokes a centrifugal unwinding of the spiral elastic band with the liberation of the pin or pins in the direction of a movement of unlocking of the mobile organ to a position of liberation thereof.

2. Apparatus according to claim 1, wherein the projectile presents a fixed direction of gyration, characterized in that the spiral elastic band is rolled up gradually as the said axis of gyration approaches the direction of the axis of rotation of the projectile during its flight.

3. Apparatus according to claim 1, characterized in that it comprises a plurality of securing pins uniformly spaced angularly with reference to the said axis of gyration.

4. Apparatus according to claim 1, characterized in that the means for mounting the cage with respect to the body comprises two bearings on the cage and two axially aligned seats complementary to the bearings provided in the body of the projectile, respectively in the forward abutment face and the rear abutment face.

5. Apparatus according to claim 1, characterized in that the movable organ is a gyroscopic rotor presenting an axis proper, mounted for tipping in the interior of the cage between a fixed position in which its axis proper is tipped angularly with respect to the axis of gyration and a second position in which such axes coincide, the rotor tending to tip from its first to its second position during the gyration of the body.

6. Apparatus according to claim 5, characterized in that the rotor has an axial passage which forms a part of the pyrotechnic chain of the projectile when the rotor is in its second position.

* * * * *